United States Patent [19]

Eddings

[11] 4,259,709

[45] Mar. 31, 1981

[54] DECORATIVE LIGHTING ASSEMBLY

[76] Inventor: Jack L. Eddings, 2135 Walnut St., Apt. 5-A, Philadelphia, Pa. 19103

[21] Appl. No.: 903,183

[22] Filed: May 8, 1978

[51] Int. Cl.[3] ..... F21V 7/00

[52] U.S. Cl. ..... 362/231; 362/237; 362/240; 362/346; 362/811

[58] Field of Search ..... 362/811, 295, 212, 237, 362/238, 240, 251, 252, 202, 349, 350, 351, 345, 347, 231, 227, 346

[56] References Cited

U.S. PATENT DOCUMENTS

| | | | |
|---|---|---|---|
| 3,539,801 | 11/1970 | Babrick | 362/240 |
| 3,701,897 | 10/1972 | Pennington et al. | 362/811 |
| 3,789,211 | 1/1974 | Kramer | 40/902 |
| 3,805,049 | 4/1974 | Frank et al. | 362/811 |
| 4,135,232 | 1/1979 | Berkenhoff | 362/346 |

OTHER PUBLICATIONS

Light Boxes, Edmund Scientific Co., Barrington, N.J., 08007, 1969, pp. 11.1–11.6.

*Primary Examiner*—Harold J. Tudor
*Attorney, Agent, or Firm*—Stanley B. Kita

[57] ABSTRACT

An arrangement of multi-colored randomly-flashing lamps provides a decorative lighting effect which is particularly pleasing when viewed while listening to music. The lamps are mounted in a plurality of lamp reflectors which are disposed in a honeycomb-like array which is mounted in a frame. Preferably, a series of five lamps are mounted in each reflector. A series of flashers corresponding in number to the number of lamps in each reflector function to power the lamps in random sequence so that various colors and color blends are produced.

8 Claims, 6 Drawing Figures

DECORATIVE LIGHTING ASSEMBLY

FIELD OF THE INVENTION

The present invention relates to decorative lighting devices, and more particularly, the present invention relates to multi-colored flashing lamp assemblies which find paarticular utility when viewed while listening to music.

BACKGROUND OF THE INVENTION

Various decorative lighting devices are known. Examples of patented devices known to the present applicant are disclosed in U.S. Pat. Nos. 3,949,350; 3,811,041; and 3,767,903. Although each of these devices may function satisfactorily for its intended purpose, there is an ever-present demand for a decorative lighting device which provides a pleasing effect when viewed while listening to music.

OBJECTS OF THE INVENTION

With the foregoing in mind, it is a primary object of the present invention to provide a novel decorative lighting assembly which provides a pleasing effect when viewed while listening to music.

Another object of the present invention is to provide a unique decorative lighting assembly which produces a myriad of various colors and color blends which do not repeat in any definite pattern.

A further object of the present invention is to provide an improved decorative lighting assembly which emits multi-colored lights in random fashion to provide an entertaining effect which is particularly pleasing while listening to music.

SUMMARY OF THE INVENTION

As a more specific object, the present invention provides a decorative lighting assembly which is specifically designed to be used in conjunction with various types of music to provide an entertaining lighting effect. The assembly comprises a frame in which is mounted a series of lamp reflectors molded into a honeycomb-like structure. A series of lamps of different colors, preferably five in number and at least three of which are the primary colors, are mounted in each reflector. A separate random flasher unit is provided for each lamp in the series, and each flasher is connected to one lamp in each of several different reflectors. When operated in conjunction with music, the assembly functions to emit light of various colors and in various patterns which provide the illusion of being synchronized with the tempo of music and/or being in synchronism with various tonal qualities of the music.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENTS

Figure 1:
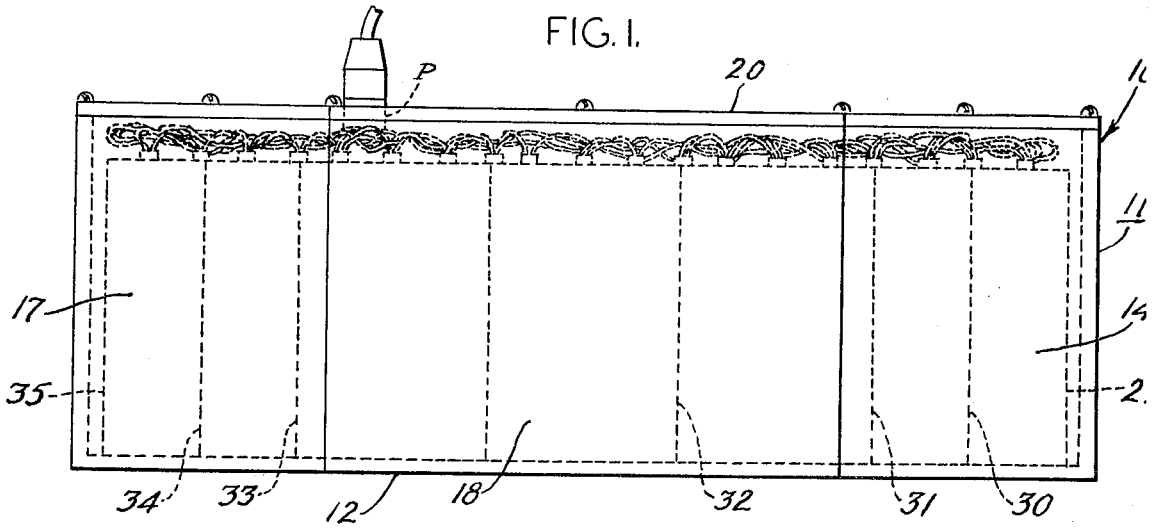
FIG. 1 is a plan view of a decorative lighting assembly embodying the present invention.
Figure 2:
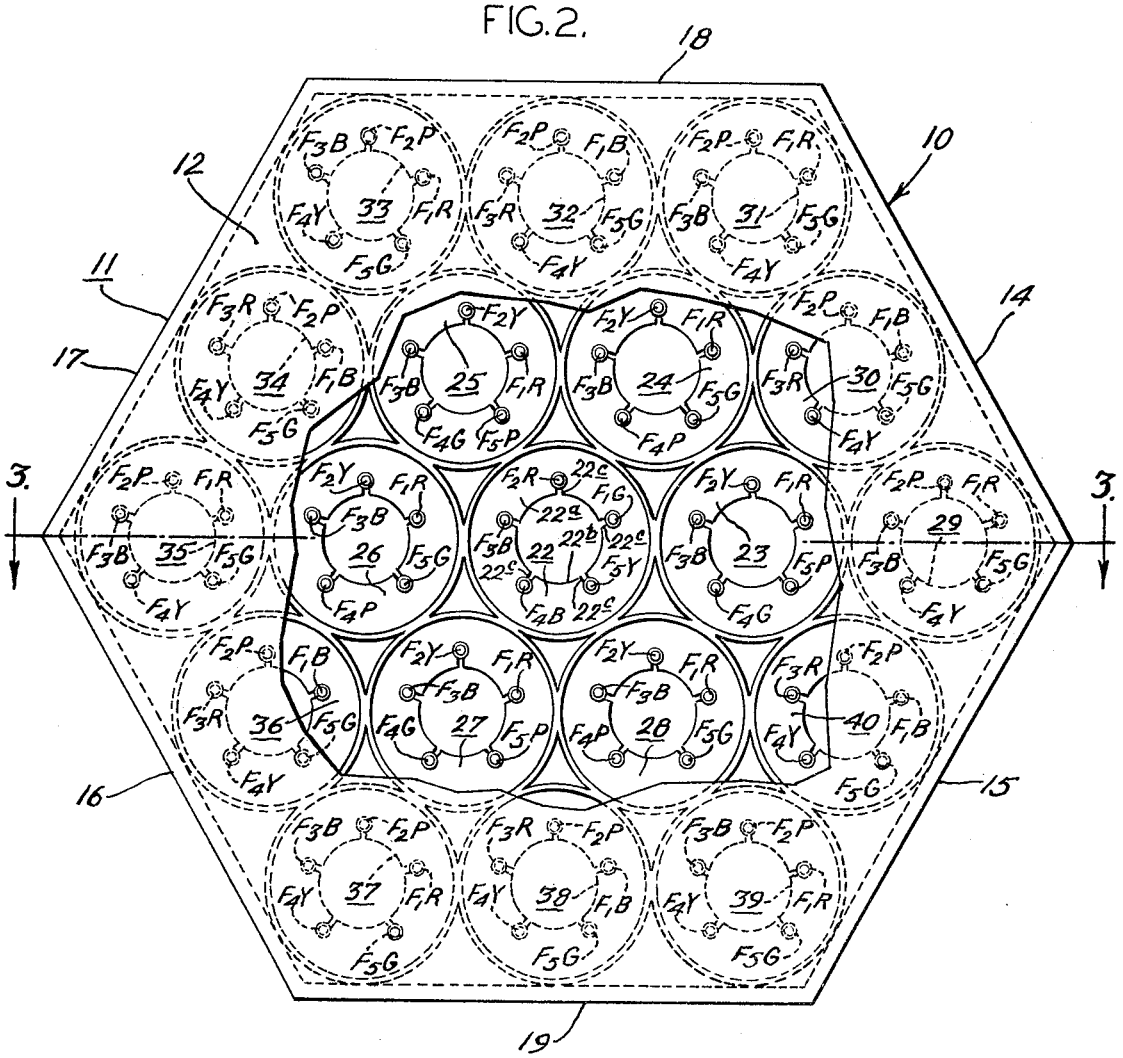
FIG. 2 is a front elevational view with a central portion broken away to expose several reflectors and lamps mounted therein.
Figure 3:
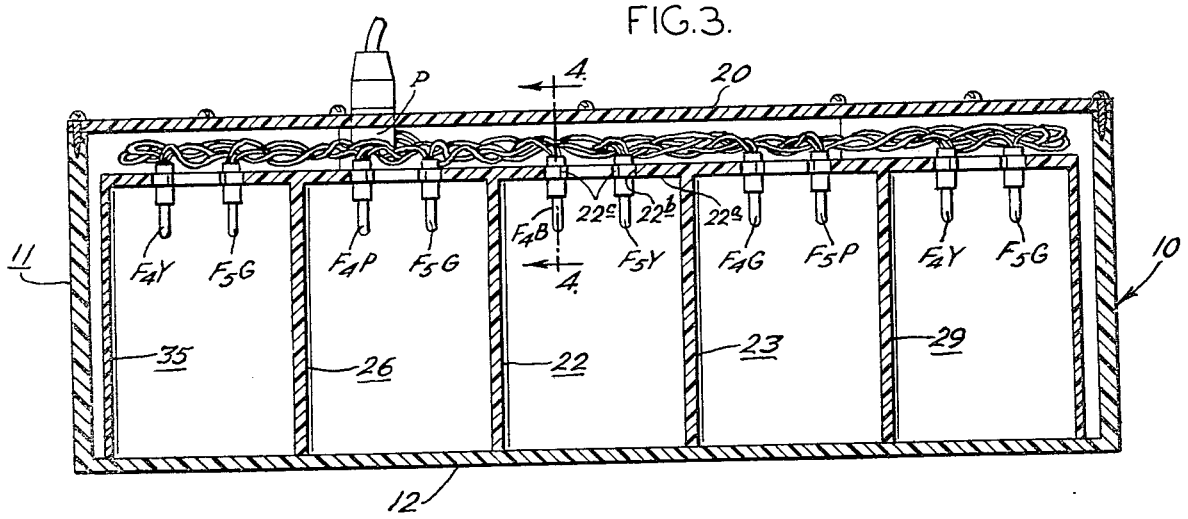
FIG. 3 is a sectional view taken on line 3—3 of FIG. 2.
Figure 4:
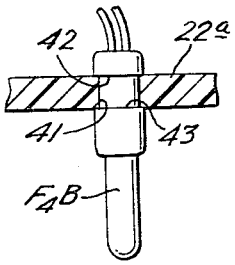
FIG. 4 is an enlarged fragmentary sectional view taken on line 4—4 of FIG. 3 to illustrate a typical lamp socket mounting arrangement.

Referring now to the drawings, FIGS. 1 and 2 illustrate a decorative lighting assembly 10 embodying the present invention. The lighting assembly 10 comprises a frame 11 having a translucent front panel 12, side walls 14, 15, 16 and 17, and top and bottom walls 18 and 19, respectively. Preferably, the front panel 12 has a mottled or irregularly faceted outer surface to disperse light. Preferably, the front panel 12 is molded of plastic material integral with the other panels 14–19 to provide an enclosure. A rear panel 20 is mounted across the back of the frame and is preferably perforated to afford cooling of the lamp assembly. The side, top and bottom walls preferably have a regularly-faceted or diamond-like outer surface to disperse light emmanating from the interior of the enclosure.

As best seen in FIG. 2, a plurality of tubular lamp reflectors, such as the reflectors 22–40 are mounted in the frame 11. In the present instance, the reflectors 22–40 are molded together of a translucent opaque plastic to form a rigid unitary honeycomb-like structure which fits within the walls 14–19 of the frame 11 in the manner illustrated. The reflectors may be regarded as being grouped in rings concentric with the central reflector 22, the inner ring comprising the reflectors 23–28, and the outer ring comprising the reflectors 29–40. Although the reflectors 22–40 are disposed in a hexagonal pattern in the illustrated embodiment, other patterns can be utilized, depending on the effect desired. For instance, it may be desirable for reflectors to be grouped into various other geometric configurations such as: squares, circles, rectangles, triangles, etc.

A series of lamps of different hues are mounted in each reflector. In the illustrated embodiment, each reflector, such as the central reflector 22, has a base end or portion **22*a* with a central aperture 22*b*. A series of narrow slots 22*c* are equally spaced apart in the periphery of the aperture 22*b* to mount the lamps: $F_2R$, $F_1G$, $F_5Y$, $F_4B$, $F_3P$ (shown clockwise in FIG. 2). Preferably, each lamp such as the lamp $F_4B$ has a recess 41 providing a pair of spaced shoulders 42 and 43 engaging opposite sides of the base portion 22*a* of the reflector 22. With the foregoing structure, each lamp such as the lamp $F_4B$ can be mounted in position in the reflector 22 simply by pushing it forwardly through the aperture 22*b* and sliding it laterally in the slot provided therefor in the reflector base 22*a*** into position. This structure facilitates removal and replacement of lamps.

In the disclosed embodiment, the lamps mounted in the reflectors are of different hues for each reflector. Each reflector should have five different hues, and three of the hues should be the three primary colors: red (R), blue (B), and yellow (Y). The remaining lamps in the series are preferably green (G) and pink (P). Clear lamps are not desirable. As will be described, the use in each reflector of the primary colors is highly desirable because of the various color blends which are produced when the assembly is in use. Also, as will be discussed, five lamp flashers are employed: $F_1$, $F_2$, $F_3$, $F_4$, $F_5$. The lamp color and the flasher which controls the lamp color are therefor designated, for example, as in $F_1R$, $F_2B$, $F_3Y$, $F_4G$, and $F_5P$, and combinations thereof.

It has been found that the various lamp hues should be placed in particular locations in the reflectors to obtain optimum performance. For instance, it is preferable for the lamps in the central reflector 22 to be grouped with a red hue at the 12 o'clock position, a green hue at about the 2 o'clock position, a yellow hue at about the 5 o'clock position, a blue hue at about the 7 o'clock position and a purple hue at about the 10 o'clock position. In the inner ring of reflectors 23–28 surrounding the central reflector 22, the 12, 2 and 10 o'clock positions have the yellow, red and blue hues, respectively, and the 5 and 7 o'clock positions alternate purple and green hues in the clockwise direction beginning with the reflector 23 located at the 3 o'clock position in the inner ring. In the outer ring of reflectors 29–40 surrounding the inner ring, the hues are distributed with the purple, green and yellow hues at the 12, 5 and 7 o'clock position, respectively, and the red and blue hues alternating between the 2 and 10 o'clock positions in the clockwise direction beginning at the reflector 29 located at the 3 o'clock position in the outer ring. Although this distribution of lamps and hues has been found to give a pleasing effect, the distribution disclosed is given by way of example and is not intended to be limiting in any respect.

Figure 6:
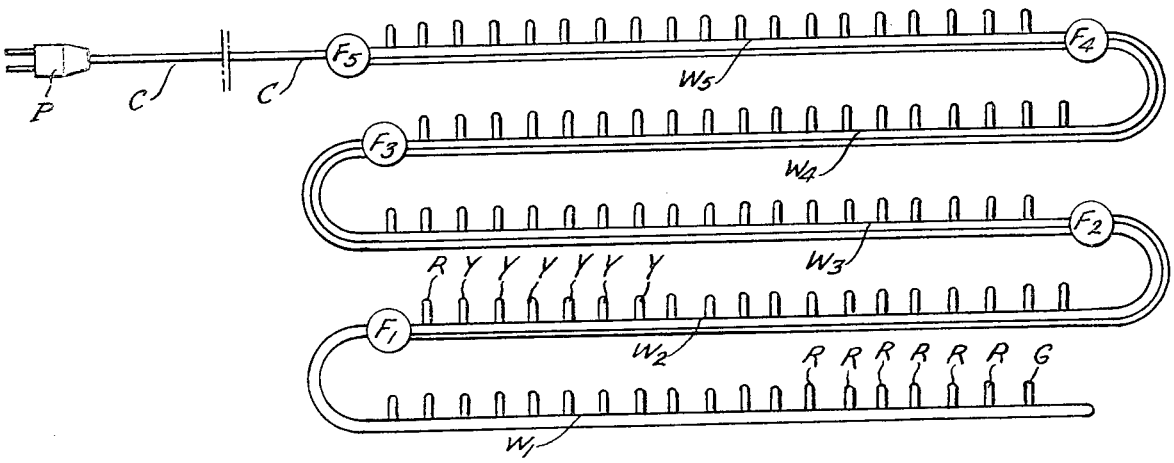
FIG. 6 is a schematic wiring diagram of the lamps and their flashers.

The various lamps are illuminated in a predetermined manner. For this purpose a series of lamp flasher units: $F_1$, $F_2$, $F_3$, $F_4$, and $F_5$ (FIG. 6) are provided corresponding in number to the number of lamps in each reflector. Each flasher unit, such as the flasher unit $F_1$, is designed simultaneously to illuminate the lamps connected thereto such as the lamps $F_1R$, $F_1B$, $F_1G$, etc. connected to flasher $F_1$ (FIG. 6). The flasher units are of a conventional design which causes them to power the lamps at random. Preferably, the flashers are of the type which are commonly used in conventional "Christmas-tree" lamp assemblies. In some of these assemblies the flashers have clear lamps; however, if these are used they are simply placed toward the rear of the frame 11 so as not adversely to affect the colors. The flashers are essentially identical in that the duration of each flash is short (a fraction of a second) and the flasher intervals are substantially equal. The flashers are not, however, synchronized, so that each operates independently of the other in point of time.

Figure 5:
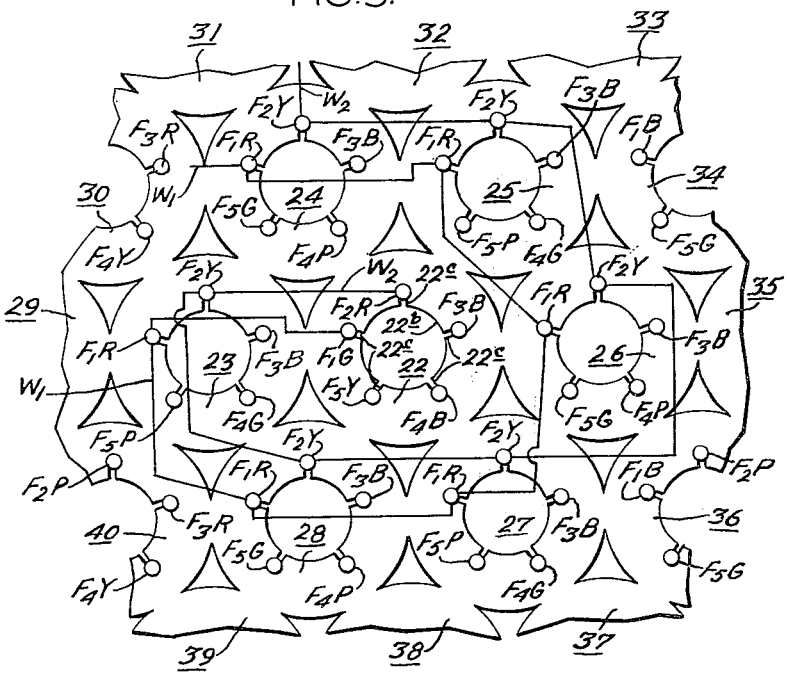
FIG. 5 is a fragmentary view of the rear of several centrally-located reflectors schematically illustrating the disposition of one string of lamps.

The lamps in the various reflectors are connected in a predetermined manner. To this end, circuit means connects a separate flasher to one lamp in each reflector and connects one lamp in each reflector with one lamp in each of the other reflectors. The circuit means is illustrated schematically in FIGS. 5 and 6. For instance, beginning at the central reflector 22, the lamp $F_1G$ in reflector 22 is connected to the lamp $F_1R$ in the reflectors 23, 28, 27, 26, 25 and 24 by the wire $W_1$, substantially as shown. The lamp $F_2R$ in the central reflector 22 is connected via the wire $W_2$ to the lamps $F_2Y$ in the same reflectors. The other lamps in the central reflector 22 having the same subscripts, i.e., $F_3$, $F_4$ and $F_5$ are similarly connected by wires $W_3$, $W_4$, and $W_5$. These wires have, however, been omitted from FIG. 5 for purposes of clarity, and the wires $W_1$ and $W_2$ have been illustrated as a single line in FIG. 5 for purposes of clarity, it being understood that the wire $W_1$ consists of two leads and the wire $W_2$–$W_5$ consisting of three leads each. (See FIG. 6.) The flasher $F_5$ is connected via a cord C to a plug P adapted to be plugged into 120 V.A.C. 60 cycle house current.

In the disclosed embodiment, each reflector is cylindrical and has a ratio of length to diameter of about 1.4 to 1. A preferred length for each reflector is about 5 inches. If desired, each reflector may taper slightly outward in the forward direction from its base in somewhat of a frusto-conical shape.

In operation, the plug P is plugged into a wall receptacle. After a brief period of warm-up for the flasher units $F_1$–$F_5$, the lamps in the various reflectors begin to flash in random. By virtue of the circuit connection of the lamps in the various reflectors, and the use of different colors, the random flashing produces various colors and color blends which do not repeat in any definite pattern. Hence, an almost infinite variety of colors and color patterns are produced. It has been found that when the device 10 is viewed in combination with background music, the effect induced on an observer may vary with the observer. For instance, some observers perceive the lamps as flashing in synchronism with the music. In other words, when the music has a fast rhythm, the lamps seem to flash quickly. When the music has a slow rhythm, the lamps seem to flash slowly. Other observers perceive the colors as flashing in synchronism with particular tones or blends. Still other observers perceive patterns of colors which appear to be synchronized with beat, tones, etc. Thus, the present invention now provides a decorative lighting display which is particularly entertaining when operated in conjunction with music.

While a preferred embodiment of the present invention has been described in detail, various modifications, alterations and changes may be made without departing from the spirit and scope of the present invention as defined in the appended claims.

I claim:

1. A decorative lighting assembly comprising:

a frame having a rear panel and a translucent front panel spaced therefrom, a plurality of lamp reflectors mounted in said frame in close proximity with one another, each reflector being elongated and extending between said panels for a sufficient distance as to project a discrete area of light on said front panel, a series of lamps of various hues mounted in each lamp reflector adjacent said rear panel so that light from the lamps reflects in the reflector and mixes before being projected on said front panel, a series of lamp flashers corresponding in number to the number of lamps in each reflector, and circuit means in said frame connecting a separate flasher to one lamp in each series and connecting said one lamp in each series with one lamp in each of the other series, whereby the reflectors are randomly illuminated with mixed colors to produce a decorative lighting effect on the front panel of the frame.

2. A decorative lighting assembly according to claim 1 wherein said lamp series includes at least three lamps each of which has a hue different from the other.

3. A decorative lighting assembly according to claim 2 wherein said three hues include the primary colors: red, blue and yellow.

4. A decorative lighting assembly according to claim 3 wherein said lamp series includes five lamps spaced apart in each lamp reflector in a predetermined pattern.

5. A decorative lighting assembly according to claim 1 wherein said reflectors are disposed in a honeycomb-like configuration having a base portion mounting said lamps and a tubular portion extending from said base portion and providing an open end through which light is projected by said lamps.

6. A decorative lighting assembly according to claim 5 wherein said tubular portion of each reflector is substantially cylindrical and has a length greater than its diameter in a predetermined ratio.

7. A decorative lighting assembly according to claim 6 wherein said translucent front panel has a mottled outer surface, and said honeycomb reflectors are mold together into a unitary assembly having their open ends abutting said front panel.

8. A decorative lighting assembly according to claim 8 wherein said length to diameter ratio is about 1.4:1.

* * * * *